US005745966A

United States Patent [19]

Osthoff et al.

[11] Patent Number: 5,745,966

[45] Date of Patent: May 5, 1998

[54] SINGEING DEVICE

[75] Inventors: Walter Osthoff, Wuppertal; Rainer Ebbinghaus, Mönchengladbach, both of Germany

[73] Assignee: Osthoff-Senge GmbH & Co. KG, Wuppertal, Germany

[21] Appl. No.: 675,244

[22] Filed: Jul. 2, 1996

[30] Foreign Application Priority Data

Jul. 3, 1995 [DE] Germany ..... 195 24 122.3
Mar. 16, 1996 [DE] Germany ..... 196 10 394.0

[51] Int. Cl.[6] ..... D06C 9/00

[52] U.S. Cl. ..... 26/3; 26/5; 26/81; 26/85

[58] Field of Search ..... 26/3–5, 80, 81, 26/83, 85; 28/174, 239; 432/8, 10, 11, 59; 34/611, 618, 620, 623, 624, 629

[56] References Cited

U.S. PATENT DOCUMENTS

| | | | |
|---|---|---|---|
| Re. 12,220 | 5/1904 | Meyer | 26/4 |
| 641,618 | 1/1900 | Wunderly | 26/4 |
| 758,937 | 5/1904 | Sarfert | 26/4 |
| 816,018 | 3/1906 | Kraemer | 26/4 |
| 919,999 | 4/1909 | Allsop et al. | 26/5 |
| 1,047,875 | 12/1912 | Allsop et al. | 26/5 |
| 1,132,883 | 3/1915 | Skitt | 26/5 |
| 1,205,099 | 11/1916 | Marshall | 26/5 |
| 2,589,344 | 3/1952 | Cohn et al. | 26/81 |
| 3,875,624 | 4/1975 | Frezza | 26/81 |
| 4,475,417 | 10/1984 | Dornier | 26/3 |
| 4,641,403 | 2/1987 | Osthoff et al. | 26/3 |
| 4,794,677 | 1/1989 | Strudel | 26/3 |

FOREIGN PATENT DOCUMENTS

| | | |
|---|---|---|
| 2213631 | 10/1973 | Germany . |
| 3621643 | 12/1987 | Germany . |
| 19517718 | 5/1995 | Germany . |
| 29505376 | 12/1996 | Germany . |
| 575496 | 5/1976 | Switzerland . |

*Primary Examiner*—Amy B. Vanatta
*Attorney, Agent, or Firm*—Martin A. Farber

[57] ABSTRACT

A singeing device (V) for the gassing of circular goods (1), for instance circular knitted textile goods, having a singe burner (3) and a cloth guide (W) in order to obtain uniform gassing. The guidance of the goods (W) is developed so as to result in flat sides (a) of the circular goods (1) which extend substantially parallel to each other and rounded transition sides (b), and the singe burner (3) gasses the circular goods (1) both on the flat sides (a) and on the transition sides (b).

30 Claims, 7 Drawing Sheets

V
R
II
19
20
22
1
y
b
Ü
10
11
17
E
29
18
24
8
9
6'
6
7
x
2
5
12
13
W
a
15
4
14
I
3

R
II
20
19
22
1
b
Ü
10
11
17
E
II
29
18
9
10
22
8
6'
6
7
1
x
b
24
2
5
12
1
W
13
-a-
4
14
I
15
5
12
1
2
Ü
b
8
6'
6
7
3
24
9
22
V
29
18
19
10
II
20
E
17
11
16

SINGEING DEVICE

FIELD AND BACKGROUND OF THE INVENTION

The present invention relates to a singeing device for the gassing of circular goods, for instance circular knitted textile goods, having a singe burner and a cloth guide.

A singe burner of this type is known from Federal Republic of Germany Patent 36 21 643. The guide for the cloth has a ring-shaped spreader. Burner units which surround it and have their burner slits directed against the circular goods are also of annular shape. They are directed radially all around.

The object of the invention is to develop a singeing device of this type further in the manner that the symmetrical ring-shaped central system is replaced and the circular goods offer very predominantly a flat gassing surface and the portions deviating from the correspondingly flat course constitute only a fraction of the periphery.

In Federal Republic of Germany Patent 22 13 631 it is furthermore proposed to guide flat textile structures in the form of a woven or knitted fabric stretched out taut in a single layer and singe them tangentially in the region of their deflection on a table edge of a singeing device.

Finally, a structure of oval section for guiding of the goods on a machine for the transverse stretching of knitted circular goods is also known (Swiss Patent 575 496). The wide surfaces thus produced pass, in the region of the stretching, into a trapezoidal shape which widens increasingly in the direction of travel.

SUMMARY OF THE INVENTION

In order to achieve the above-mentioned object, the present invention provides a singeing device of this type, that the goods be so guided as to produce flat sides of the circular goods which extend substantially parallel to each other and rounded transition sides and that the flame of the singe burner strike the circular goods both on the flat sides and on the transition sides. In this way, the goods can be excellently controlled. The proportion of the wall portions of the circular goods which is brought into the flat shape is several times greater than the transition sides forming the reversals. The portions of the singe burner which are used here need only cover a relatively small surface and are accordingly of small structural size, which increases the possibility of their mechanical control. Thus, viewed from the standpoint of the cross section the guide for the cloth is practically a flat holder. In particular, well-proven long-burner elements can be predominantly used. Accordingly, it is furthermore advantageous for the singe burner of the singeing device to be developed in several parts and have, on the one hand, substantially straight long-burner elements associated with the side surfaces and, on the other hand, substantially arc-shaped circular burner elements associated with the transition sides. The conversion of the predominantly flattened cross section of the circular goods into small loop-like roundings not only avoids a local straining of the goods passing through but serves to favor the passage.

Furthermore, an equally entitled favorable rounding is afforded which serves to make the gassing uniform. With a concentric rounding of wall portion and circular burner element a very sensitive adjustment of the flame can even be obtained. Here also, local control of the intensity is possible. One can speak in a figurative sense of a "dimming" of the singeing flame. In this connection, another advantageous measure can consist therein that the long-burner elements and the circular-burner elements overlap in the direction of travel of the goods. In this connection, one proceeds preferably in the manner that the long-burner elements are located at the rear in the direction of travel of the goods. Therefore, the transition sides are gassed first, whereupon the entire wide side is gassed on both sides.

One solution, which is even of independent importance, consists furthermore therein that the singeing device is adjustable with respect to the width of the flat sides in order to adapt it to different sizes of the circular goods. Here, it is sufficient if one of the loop sections, i.e. transition sides, is moved in and out. By the adjustment obtained, this movability can at the same time be used for a suitable tensioning of the circular goods. This maintains the flatness of the flat sides even at high speeds of travel. Their edges remain parallel even in the lengthwise direction. Furthermore, the invention proposes that the adjustment be telescopic. In this way, variable identical operating conditions result for all setting widths. There is concerned here specifically an initial urging of the singeing device in the direction of the largest possible displacement.

It is structurally advantageous in this connection if the pre-stressing of the singeing device is taken up by the transport roller. In combination with the support rollers customarily provided, there results herefrom, at the same time, a well-guided and practically slip-fee transport of the circular goods. The said adjustability of the singeing device can be easily obtained by a spindle drive. The latter has the advantage of a completely variable adjustment, or displacement and locking. Self-locking thread pitch is used. With respect to the portions of the singe burner which gas the transition region, it is then advantageous for the circular-burner elements to be swingable out of their singeing position into a spaced position. The long-burner elements are also swingable in the same way. The manner of operation of both of them is such that when the singeing machine is turned off, the corresponding swinging away is positively effected so that the goods themselves are not damaged in this stage. With regard to the drive, it is furthermore proposed that at least one circular-burner element be movable on the spindle of the spindle drive. Naturally, an opposite control of the transition sides can also form the basis. However, a single-side control is preferred.

Furthermore, it also is favorable for the circular-burner element to be displaceable in a manner derived from the spindle drive. Structurally, this is furthermore represented by the fact that the circular-burner element is arranged on a carriage which can be moved parallel to the spindle drive. Another advantageous proposal is that the long-burner elements be adapted in their length to the maximum width of displacement of the singeing device. In order automatically to effect an opening of the singeing slot of the long-burner elements which is adjusted in length, it is furthermore proposed that the widening part of the singeing device control a burner-slot slide of the long-burner elements; this also is an advantage resulting from the flat guidance of the circular goods. Another favorable solution for the adapting of the singeing device to different sizes of circular goods is that the flat sides are formed from extendable belt elements. They serve as continuous support belt. Utilizing the thin-walled nature of the belts as is generally the case, the shape of the bend is proposed for the lengthening of the belt elements. In this connection it is advantageous for a winding reserve to be arranged in one of the transition sides. This is possible in favorable manner since these zones in the region of the belt elements are not required for the gassing and therefore for the supporting or formation of a supporting shield.

An embodiment of even independent importance results furthermore from the fact that the transition side is formed by a hollow column. A hollow column offers the correspondingly desired region for the arrangement of the winding reserve, it is light due to its hollow development, can be used in part as guide for the circular goods, and is the basis for the means for the driving of the goods. Realizing the first-mentioned type of use, one logically proceeds in the manner that the winding reserve is contained within the hollow column. For the said lengthening, one advantageous embodiment consists therein that an end of the belt element forming the flat side is fastened as fixed end to a hollow column. In this connection, it is favorable for both hollow columns to have both a fixed end and a winding reserve. This distributes the actuating loads etc. uniformly over the hollow columns. This embodiment is preferred in particular in larger singeing devices, it being nevertheless favorable in other cases to arrange fixed end and winding reserve in a common center, therefore in the one hollow column, and to use the other hollow column merely as deflection core over which the correspondingly long belt element is placed as a loop. This center or hollow column then acts as loop-enlarging pull finger.

Both in the one solution and in the other solution, it is favorable for the winding reserve to be received on a winding roll and to be fed through a window opening into the circumference of the hollow column. An advantageous feature of the invention consists therein that the winding rolls are under the action of a return spring. Upon reduction of the distance between the hollows columns which are parallel to each other, that portion of the belt element which is not needed is thus automatically pulled in. The structural expense for the corresponding measures is slight. The measure that a guide roll is arranged in front of the window on the inside would be considered as promoting guidance. It furthermore avoids regions of narrow bend so that kink marks cannot be produced on the belt element. It is then proposed that the inlet be set back by about a quarter wrap from an outlet of the belt elements from the hollow column. This deflection region is entirely sufficient although—with the use of bridge pieces in-between—practically half the circumferential zone of the hollow column of circular cross section could be used. The guidance of the belt element or elements is further optimized in the manner that, in the region of the belt guidance, the hollow columns have a guide surface for the belt element which is set back by the thickness of the belt. The set-back guide surface creates flanks directed transverse to the direction of travel of the goods in the transition regions to the outer wall of the hollow column, the narrow sides of the belt element lying opposite said flanks. Furthermore, the latter are not in the way of the circular goods which slides thereover. It is favorable for the belt element to be a rubber belt.

Furthermore, it is proposed that the long-burner elements be arranged in the region of the belt element and furthermore that the circular-burner elements be offset vertically with respect to the long-burner elements and be arranged below the belt element, referred to the direction of travel of the goods. A further development which is favorable for the guidance of the goods consists of holders for the circular goods arranged behind the belt element or elements in the direction of travel of the goods and which, extending from the facing sides of the hollow columns, protrude beyond them.

BRIEF DESCRIPTION OF THE DRAWINGS

With the above and other objects and other advantages in view, the present invention will become more clearly understood in connection with the detailed description of preferred embodiments, when considered with the accompanying drawings of which.

DETAILED DESCRIPTION OF THE PREFERRED EMBODIMENTS

The singeing device V shown is part of a singeing machine such as can be noted, for instance, from the not previously published German Utility Model Application 29 505 376.

The singeing device V shown serves for the gassing of circular goods 1, and to be sure of a flat textile structure, in particular in the form of circular knitted goods. The latter pass through the singeing device V in substantially vertical direction. The outer side of the circular goods 1 is moved in this connection past a singeing slot 2 of a singe burner designated generally as 3. The singeing flame emerging from the singeing slot 2 eliminates the fiber ends protruding from the thread of the knitted material. Such a treatment forms the basis for further finishing and is therefore of importance for dyeing.

The circular goods 1 are passed in non-circular cross section through the singeing device V or the singe burner 3 which surrounds the goods. It has a flat cross sectional shape, specifically an oval shape. The corresponding cloth guide W is formed by a flat spreader 4 which acts as shaping inner support for the circular goods 1.

Figure 6:
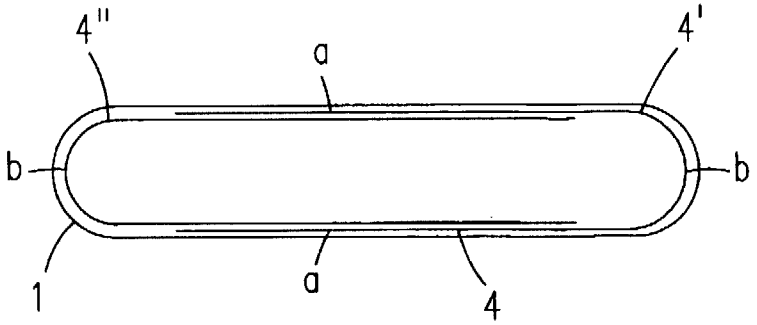
FIG. 6 is a cloth guidance diagram in cross section.

The cloth guide W is so developed as to result in flat sides a extending substantially parallel to each other and transverse convexly rounded transition sides b of the circular goods 1 (see sketch FIG. 6).

The singe burner 3, brought into operating position, follows this contour so that the flame leaving the singeing slot 2 gasses the circular goods 1 both on the flat sides a and on the transition sides b.

The singe burner 3 has a multipartite construction. It consists of two long-burner elements I and two circular-burner elements II. They are in each case of identical development and horizontal, i.e. oriented transverse to the direction of travel of the goods indicated by the arrow x.

Figure 2:
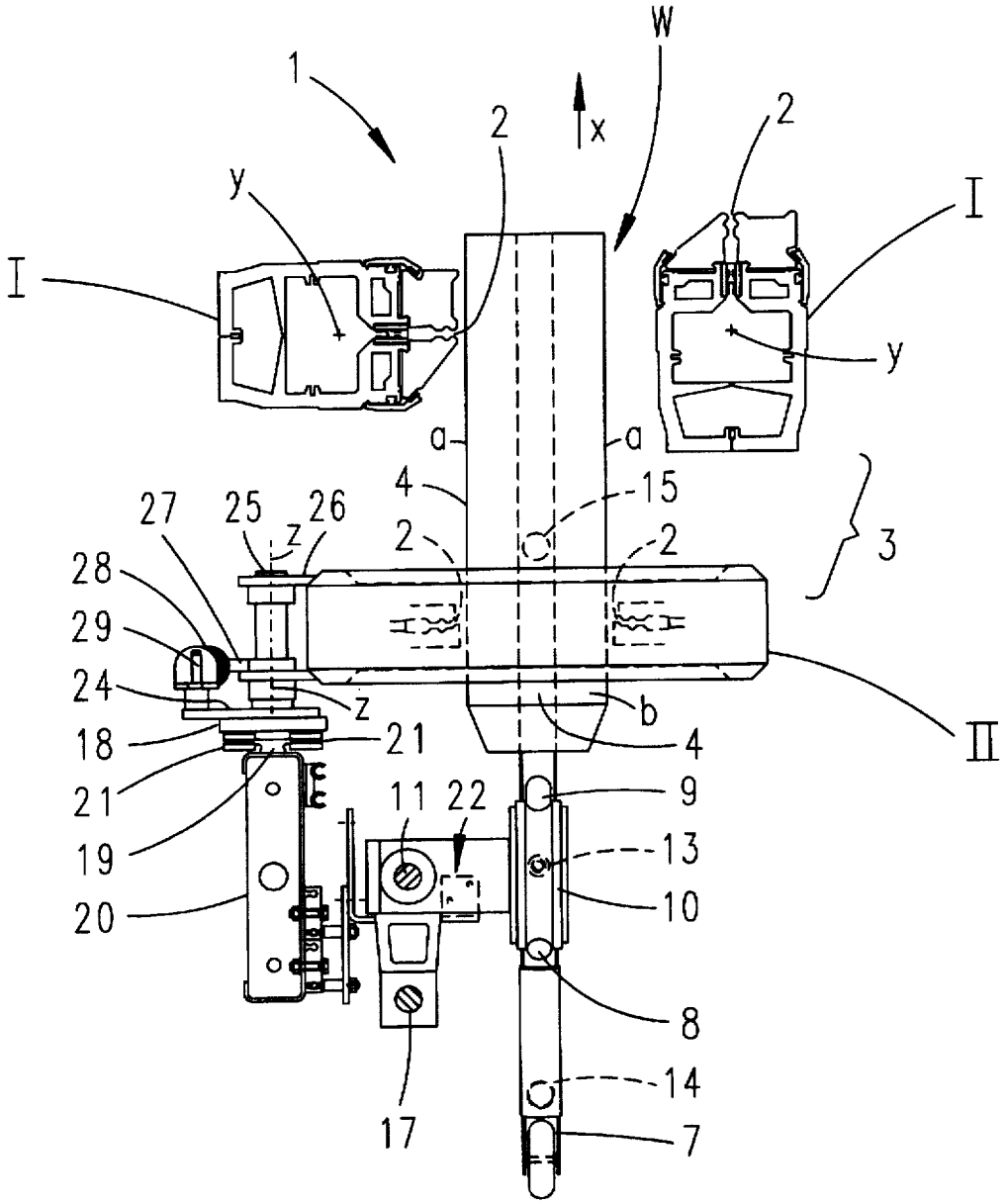
FIG. 2 is an end view thereof.
Figure 3:
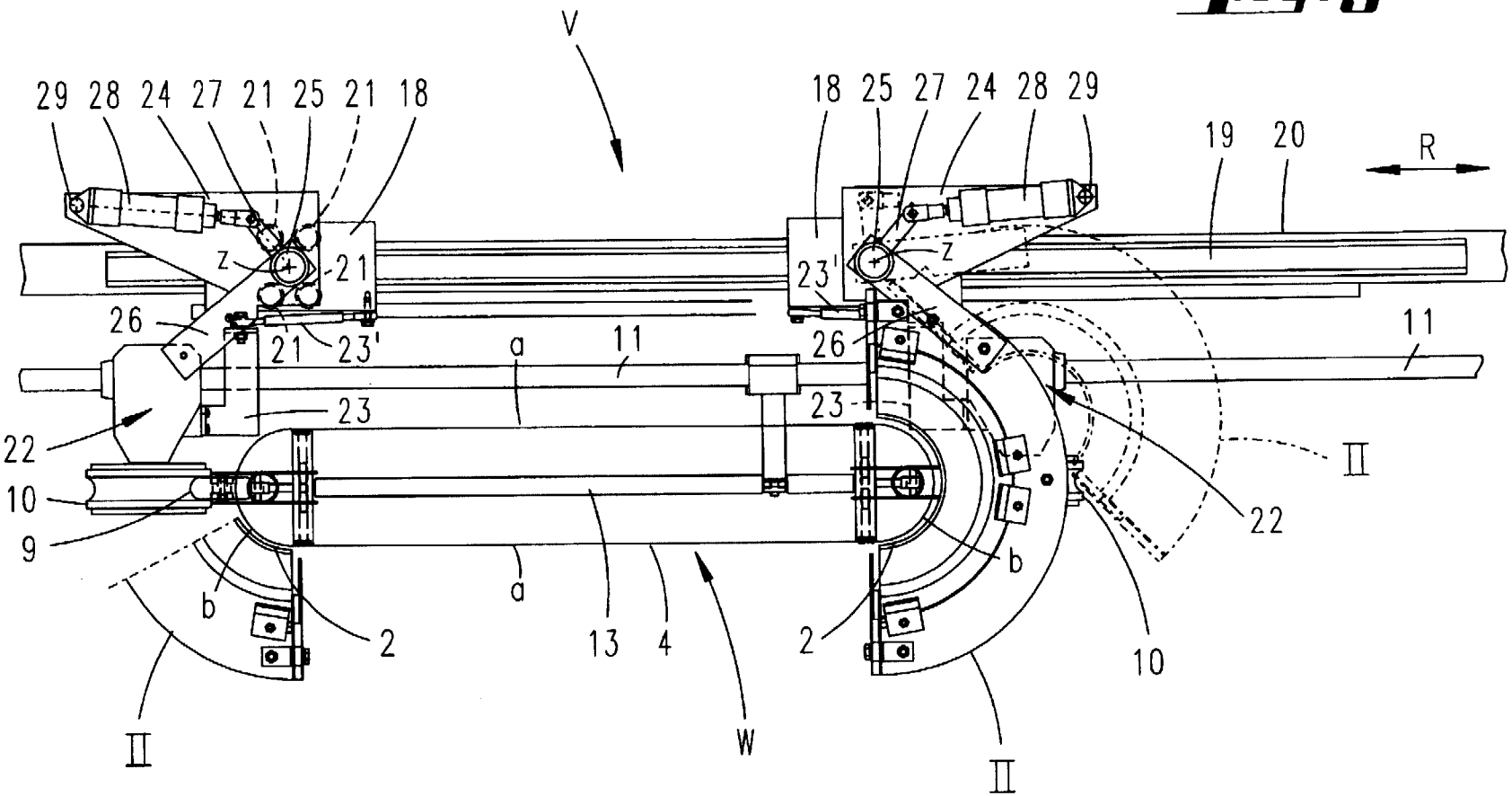
FIG. 3 is a top view of FIG. 1. in which, however the long-burner elements have been omitted for greater clarity of the drawing.
Figure 4:
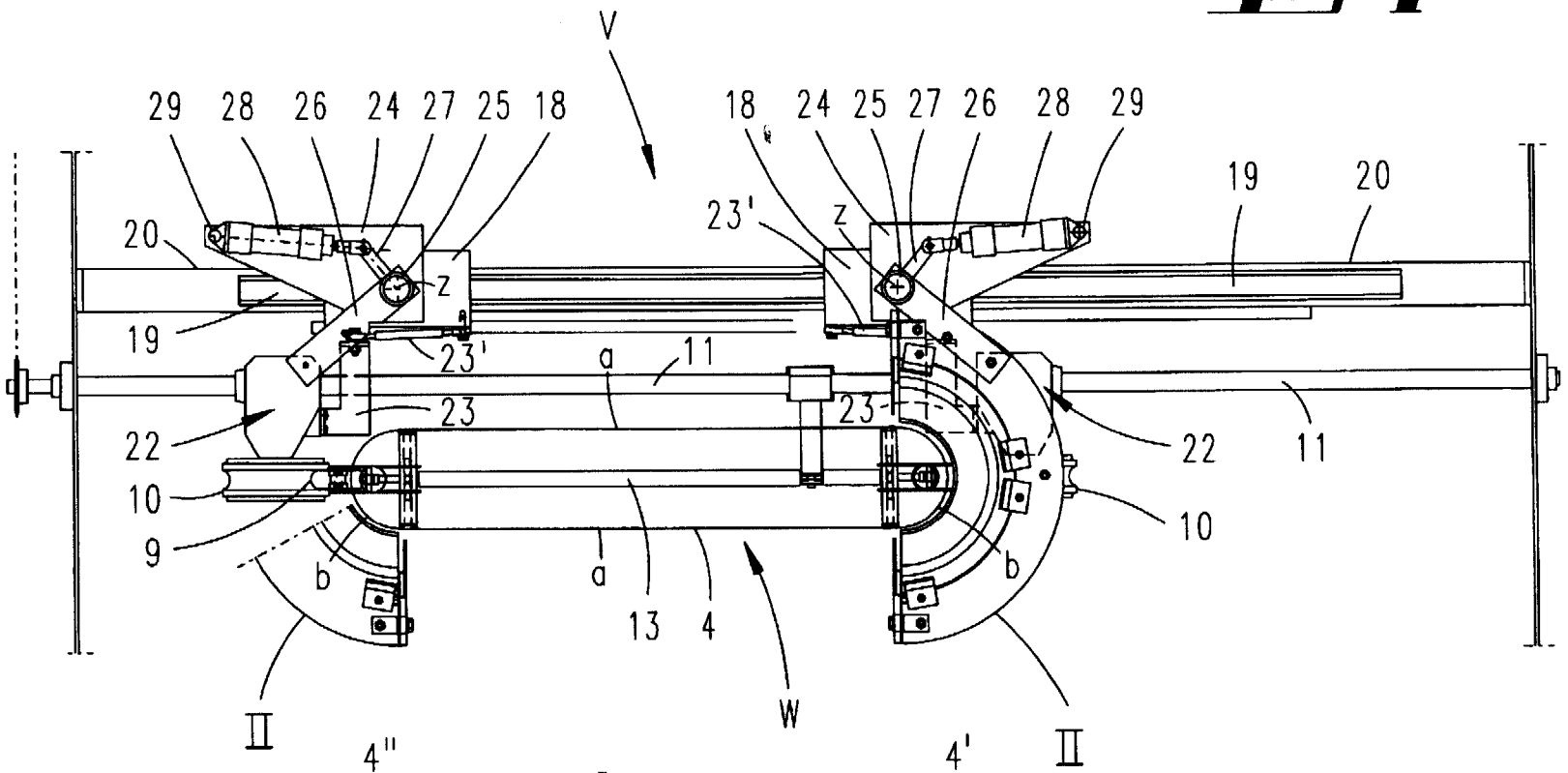
FIG. 4 is a showing corresponding to FIG. 3, on a reduced scale, containing further portions of the spindle drive.

Both the long-burner elements I and the circular-burner elements II, or more precisely semi-circular burner elements, can be brought from a working position into a spaced position with respect to the gassing surface (see FIGS. 2 and 3). This takes place, with regard to the long-burner elements I which are arranged as a pair, by tilting them around a horizontal axis of swing y—y. Their shaft, mounted in the machine housing, is not shown. The axis y—y shown lies approximately at the point of intersection of the diagonals of the burner elements I and II of box-shaped cross section, preferably in the middle of the center of gravity. The movements of displacement can be carried out independently.

The circular-burner elements II which are arranged as a pair, can, on the other hand, be swung horizontally around a vertical axis z—z from their singeing position into a position spaced from the circular goods 1. Said spaced position is shown in dash-dot line in the FIG. 3. The angle of swing is dimensioned for sufficient accessibility to the transition sides b, which are thus exposed. It is about 45°. The semicircular openings from II to II point toward each other in closed position.

Fundamental details with regard to the development of the burner are given in the applicant's not-previously published German Patent Application 195 17 718.5, the disclosure of which is incorporated in full herein also for the purpose of including features of said papers in claims of the present application, in particular with respect to the alignment of the slot.

Figure 1:
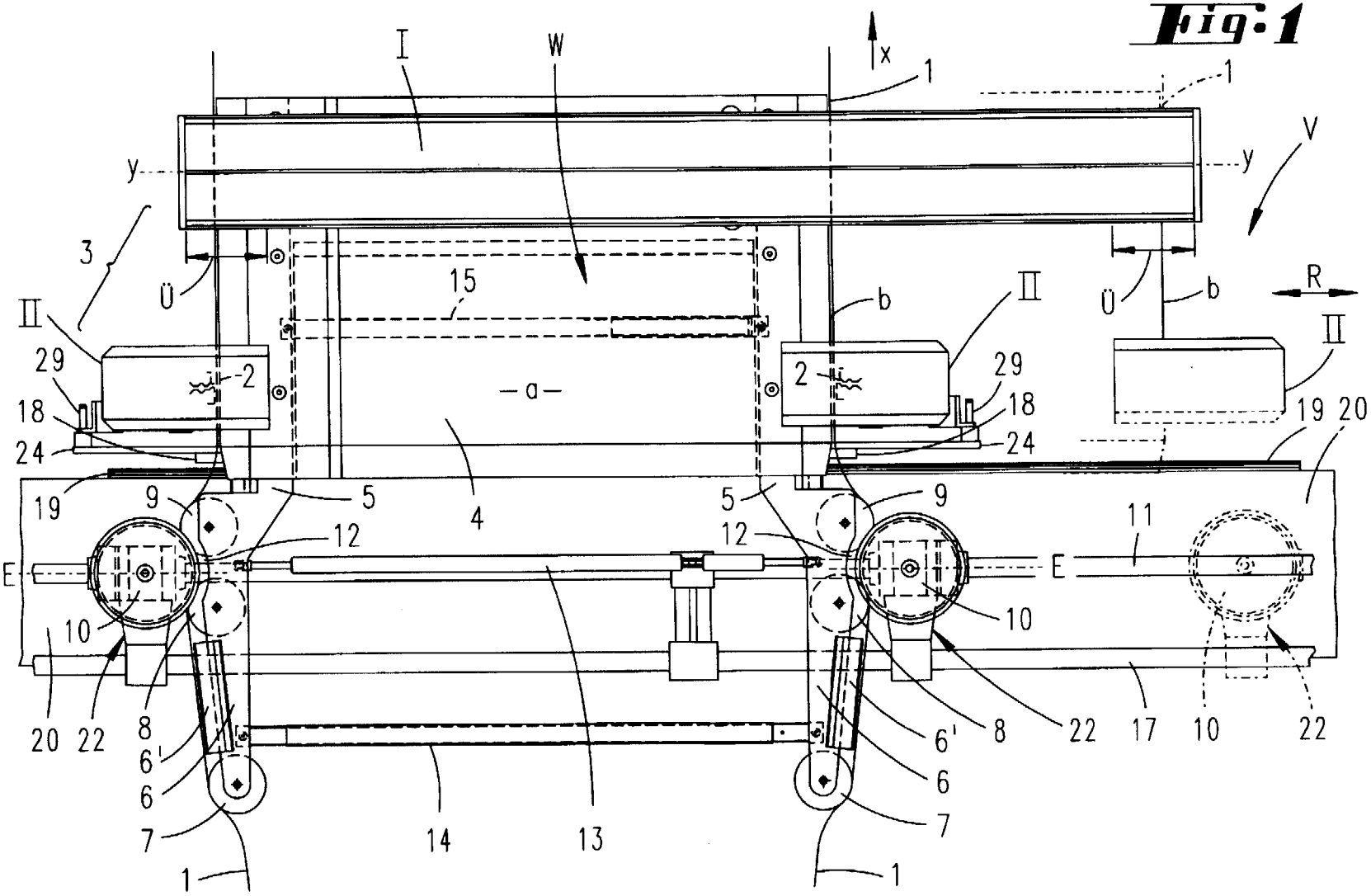
FIG. 1 shows the singeing device of the invention in side view, in accordance with the first embodiment.

The two long-burner elements I, each of which acts on a wide or flat side a, extend in a common vertical plane but displaced in height from the two circular-burner elements II acting on the transition sides b which are also installed on a common vertical plane. The long-burner elements I adjoin, in overlapping fashion, the circular-burner elements II. The two free ends of the circular-burner elements II are overlapped by the long-burner elements I. The latter elements (I) are the first, as already indicated, in the direction of travel of the cloth x and lie on top. The clear vertical spacing between the two corresponds approximately to the dimension of the height of the box of the long-burner elements I. The overlap is designated Ü in FIGS. 1 and 5. The overlap is determined by a stop and cannot be exceeded so as to prevent an interruption in the open region of the singeing slot 2. This applies also in the case of circular-burner elements II brought to a maximum distance apart, which maximum distance is established by a symmetrical equipping of the singeing device V. The possibility of displacement for this can be noted, for instance, from FIG. 5, from which it can be seen that the singeing device V can be displaced with respect to the width of the flat sides a of the cloth guide W for adjustment to different sizes of circular goods. The displacement is obtained via a horizontally guided telescoping of the flat spreader 4 of the singeing device V.

For this purpose, the flat spreader 4 is developed in detail as follows: From the actual shaping center thereof (4) which supports the back of the circular goods 1 to be treated, spreading horns 6 extend directed downwards from the foot 5 of the transition sides b. These horns converge in the direction of the standing surface of the singeing machine. Each of the free ends of the spreading horns 6 is provided with a deflection roller 7, the rollers commencing the desired gentle opening/flattening of the circular goods 1.

Adjoining the rear portion of the spreading horns 6 which faces away from the transition sides b there are vertically spaced support rollers 8 and 9. Via these rollers the entire flat spreader 4 is supported in guided manner within the circular fabric. Tangent between the said rollers 8, 9 there are slide skids 6'. They are transversely arched and beveled at least on the lower edge. The rear of the slide skids 6' produces a gentle passage thereover by the inner portion of the circular goods there.

The portion of this inner support which is on the outside of the goods is formed by a transport roller 10. The latter is spindle-driven by interposition of a gear. A gear is interposed. The drive spindle is designated 11. All rollers 7 to 10 travel on horizontally directed axes which lie transverse to the direction of displacement indicated by the arrow R.

The actual supporting of the flat spreader 4 is effected by the uppermost support roller 9 which is close to the foot. The periphery of the transport roller 10 of larger diameter extends in part into a gusset-shaped space 12 formed by the support rollers 8 and 9.

A coherent supporting surface of the core of the flat spreader 4 despite displaceability results by a correspondingly provided overlap reserve of the two-part flat spreader 4. It consists of two U-shaped parts with rounded U-web, which U-web represents the transition sides b and the U-arms of which provide telescoping sections of the flat sides a. The U-parts are merely designated 4' and 4" in FIG. 6. They can have such a wall offset in the region of the U-arms that the transition portions b have a completely identical curvature.

The internesting can be obtained by interengagement of the arms or else by overlap oriented on the same side. The former is preferred in accordance with FIG. 6. The internesting overlap is contained in the longer oval axis of the flat spreader 4 to such an ample extent that the maximum displacement path shown in FIG. 5 still assures a remaining overlap of the U-parts 4', 4". With regard to the geometry of the oval, it should furthermore be mentioned that the length between the focal points of the oval corresponds, in the minimal operating width (longer oval axis), to about 5 times the diameter (shorter oval axis) of the arcuate transition sides which are convex as seen from the outside and, in maximum operating width, to about 9 times the diameter.

The flat spreader 4 exerts a certain spreading action. This holds the circular fabric stretched flat. The singeing device V is for this purpose spring-urged in the direction towards its greatest possible displacement. The pre-stress is such that travel-inhibiting friction of the circular goods 1 is just avoided. This is effected via the action of the transport rollers 10, which form an end stop on both sides and which take up the corresponding spring spreading action/force of the singeing device V, introduced in via the support rollers 8, 9. The spring pressure is applied by a gas-pressure spring 13 which is installed in the spreading direction and interposed horizontally. Its longitudinal axis almost intersects the axes of the transport rollers 10. The end pivot regions of the gas pressure spring 13 are located in the central region of the gusset-shaped spaces 12. The plane defined by the axes of the transport rollers is designated E—E.

In addition to the cross members thus obtained, two other cross members hold the flat spreader 4 together, stabilized in practically frame-like manner. These consist of a lower telescopic tube 14 located below the support plane E—E and an upper telescopic tube 15 extending above that plane. Both extend parallel in space transverse to the gas compression spring 13, and therefore horizontally. The vertical distances apart are approximately the same. The lower telescopic tube 14 attaches shortly above the deflecting rollers 7 via support pins on the spreading horns 6. The upper telescopic tube 15 extends approximately at the mid height of the shaping center of the flat spreader 4, also held by support pins. Of course, a residual overlap upon the maximum width adjustment of the singeing device V is taken into consideration also with respect to the telescopic tubes 14, 15.

Figure 5:
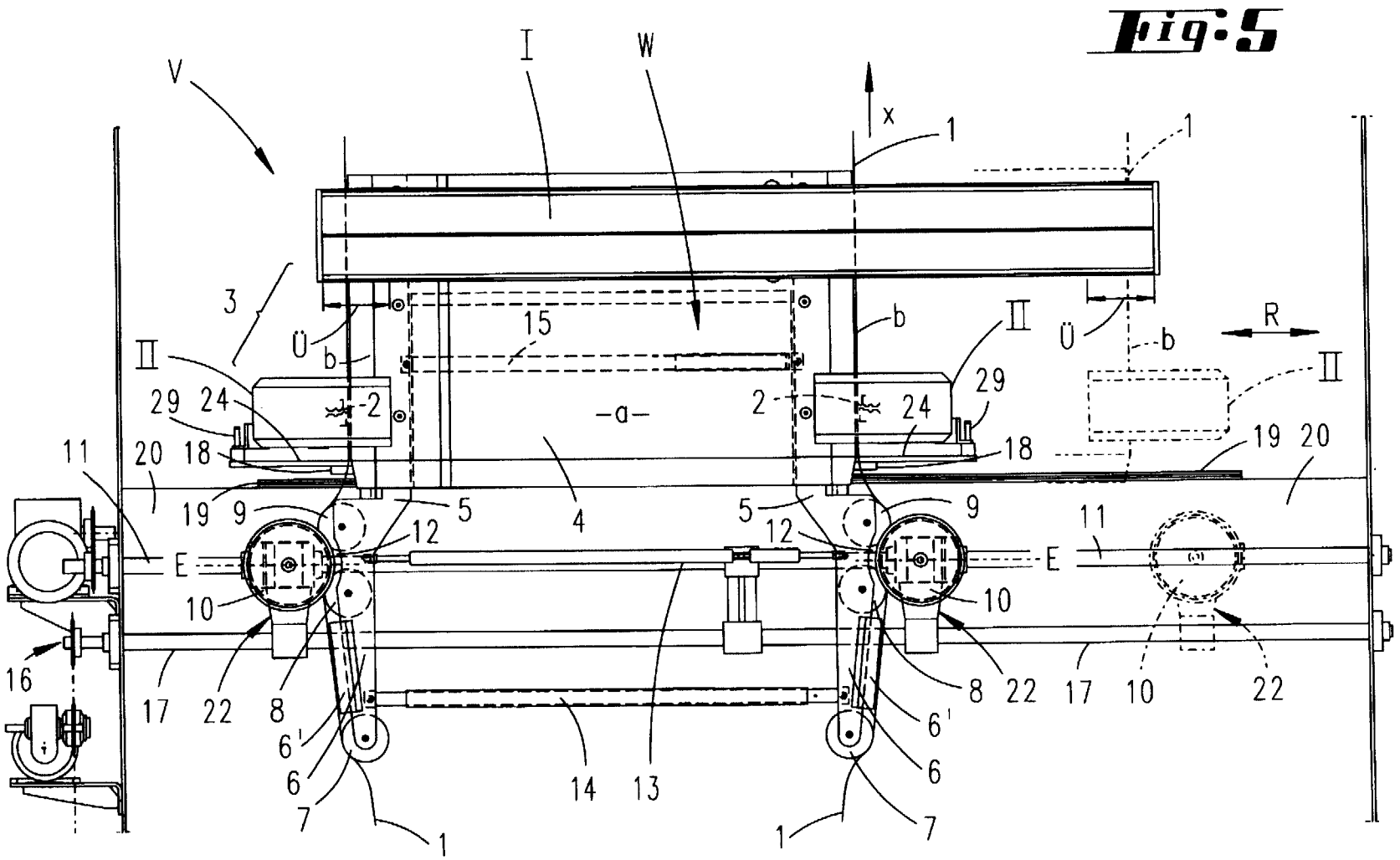
FIG. 5 is a side view which has been supplemented in this manner.

As can be noted from FIG. 5 of the drawing, the straight or stretched long-burner elements I are adapted in their length to the maximum width of displacement of the singeing device V. In the intermediate position, shown in FIG. 5, the right-hand end region of the long-burner elements I extends out in cantilevered fashion. The maximum displaceability is shown by the dot-dash line and indicates that the part of the singeing device V producing the corresponding widening of the flat sides a moves out and in here only on one side. The left-hand part of the singeing device remains stationary. It can, however, also be the outward-moving part. Outward and inward movement on both sides is also conceivable. The technical/function means necessary for this are provided accordingly in mirror symmetry.

In order to keep the cloth-free protrusion region of the long-burner elements I free of the formation of a flame, the wideness-increasing, right-hand part of the singeing device V has a burner-slot slide. It is introduced in the head on the right side and is controlled as a function of the movement. The slide which closes the burner slot is advisedly located in the tilt axis y—y of the long-burner elements I, and is therefore of neutral movement with respect to tilting (not shown).

The adjustment of the width of the singeing device V is effected via a spindle drive 16. Via its screw spindle 17, at least one circular-burner element II, in this case the right-hand one, is also moved on the spindle 17. The displacement is derived from the spindle drive 16 in the sense of a linear drive.

The displaceable circular-burner element II is arranged on a carriage 18. The carriage travels on a rail 19. The rail 19 is located on the top of a horizontal beam 20 which is connected at its end to vertical walls of the machine housing. The rail guidance is effected over grooved rollers 21 with vertically arranged axes. The driving action results from a displacement device 22 which cooperates with the spindle 11 and which via a driver 23 together with a connecting rod 23' move the carriage 18.

The carriage 18 receives, on a deck 24, a journal pin 25 for a swing arm 26 as support arm of the swingable circular-burner element II. The journal pin 25 forms the vertical shaft of the axis z. The swing arm 26 is double-armed. It passes into an actuating arm 27. The arms are at a right angle to each other. The actuating arm 27 is directed towards the bearing lug of the swing arm 26 and at its end engages in pivoted fashion on a working cylinder 28 which in its turn is also mounted on the deck 24. The end support there of the working cylinder 28 is designated 29. By the outward travel of the piston shaft of the working cylinder 28, the circular-burner element II swings into the position spaced from the corresponding transition side b which is indicated in dot-dash line in FIG. 3. The reverse travel of the piston shaft locates the singeing slot 2 concentrically around the gassing place. This is done with fine adjustment, utilizing the parameters concerning the amount of fuel, the mixture, and the profile of the cleaning slot.

The left part of the singeing device V, the stationary part here, is, as mentioned, equipped in the same manner with respect to the carriage guide, etc., but is neutralized. If an outward movement also in the left-hand direction which takes place synchronously with the opposing movement described is desired, it is merely necessary here for the corresponding spindle drive to be adapted, i.e. to have a suitable thread.

Above the singeing device V suction is provided so that burning dust is removed from the goods. This is followed by a guide roll which feeds the treated cloth to a winding device.

Figure 7:
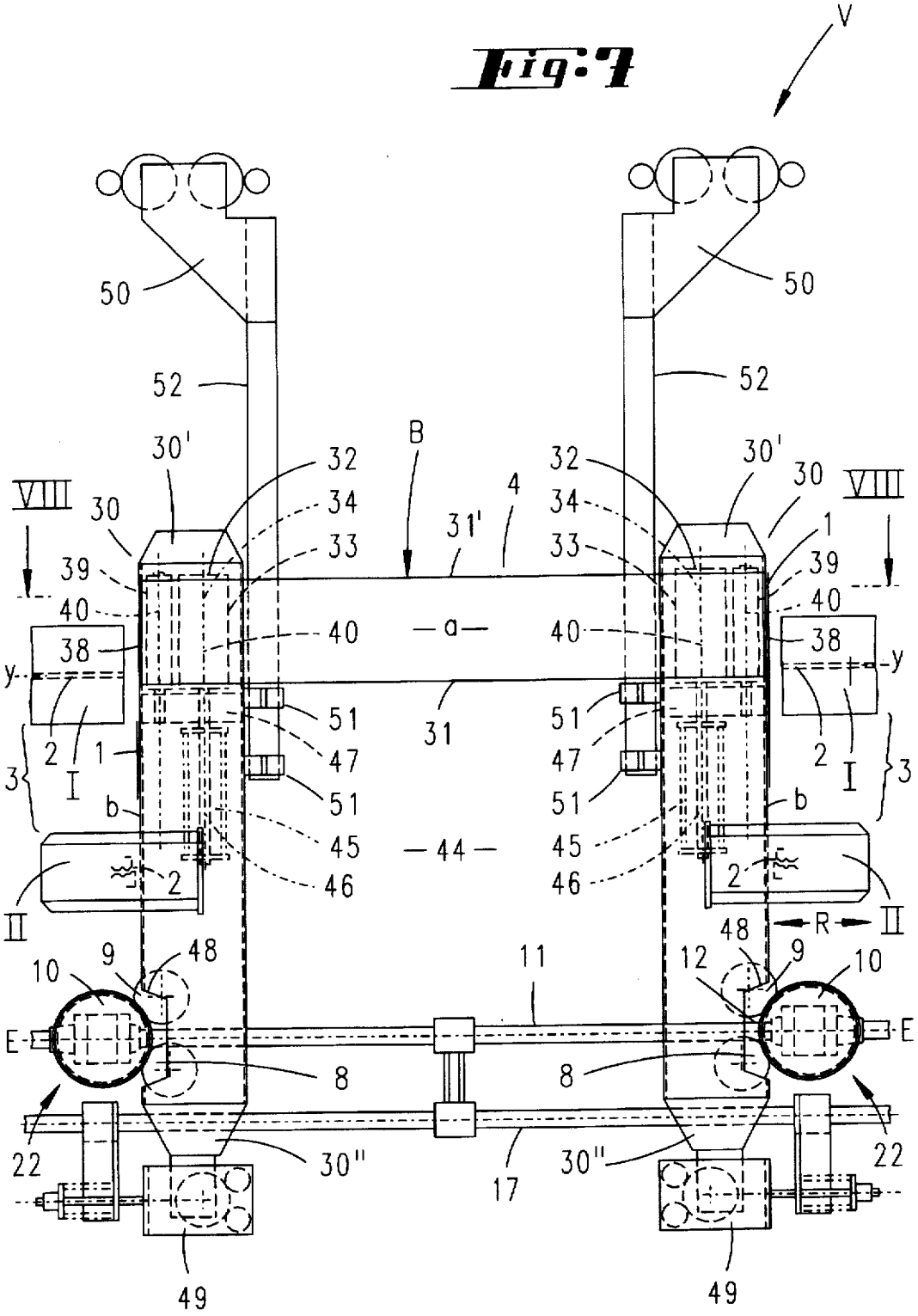
FIG. 7 shows the singeing device of the invention in a side view in accordance with the second embodiment.
Figures 8, 9:
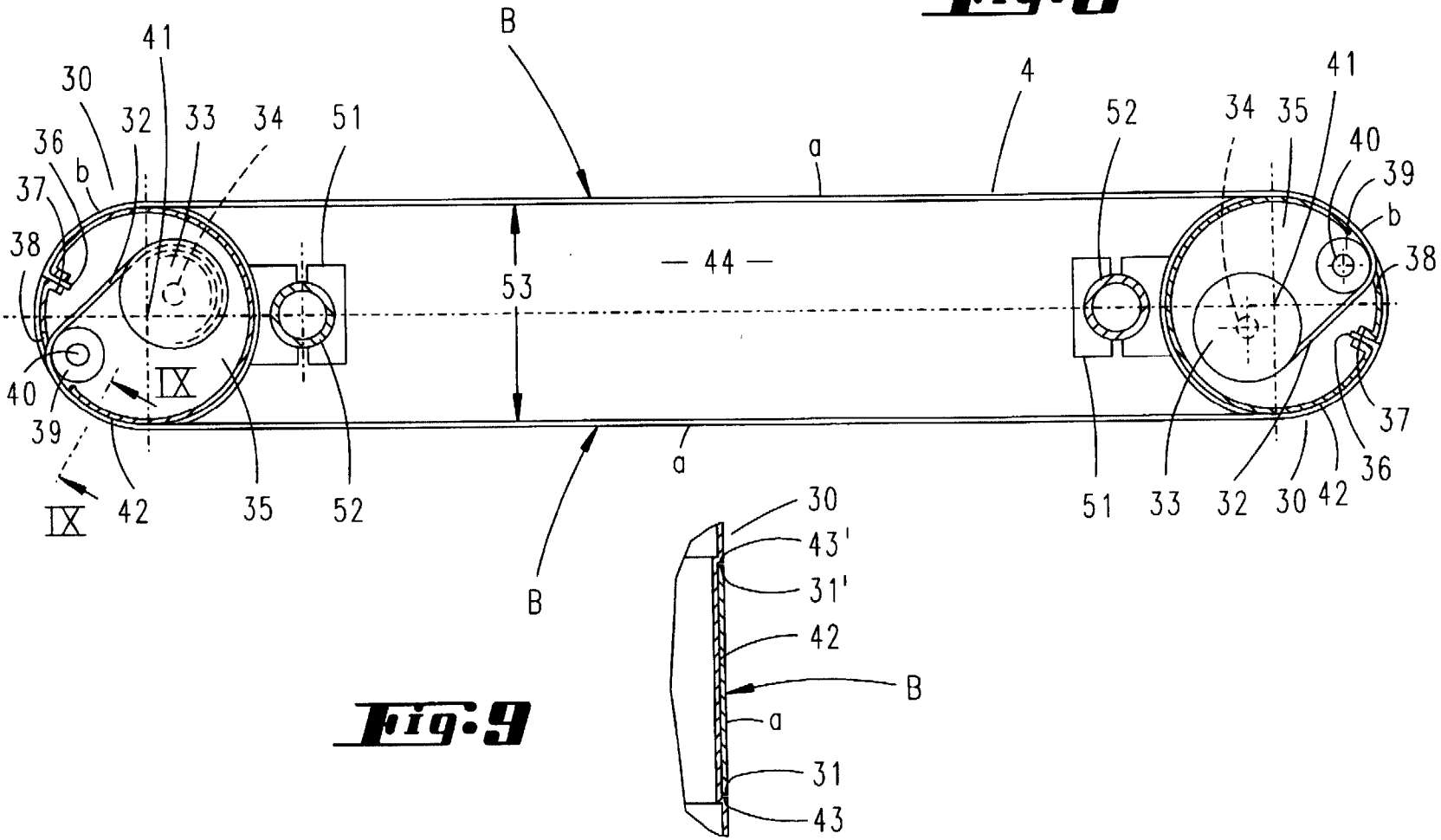
FIG. 8 is a section along the line VIII—VIII of FIG. 7, on a larger scale, and diagrammatically on the flat spreader and the anchoring means for the holders in reduced size.
FIG. 9 is a section along the line IX—IX of FIG. 8.

The singeing device V in accordance with the second embodiment which is shown in FIGS. 7 to 9 has a flat spreader 4 of modified construction. Insofar as technically equivalent means are present here, the same reference numerals have been used here, in part without repetitions in the text.

In the flat spreader 4 described in more detail below, the flat sides are no longer formed by U-parts 4', 4", but by an extendable belt element B. This permits a continuous adjustment of the width over the entire operating range of the singeing device V determined by the length of the long-burner elements I.

The continuous lengthening—also in a figurative sense—of the flat spreader 4 is effected via a change in space between two hollow columns 30 which bear the belt element B, the belt element stretching with corresponding equipment; however, for the formation of the lengthening, a reserve is formed which can be unwound and is held ready by the belt element B itself. The belt element B which acts as support belt is made of flexible material and thus in general is windable. Further parameters or properties thereof are high flexibility, lack of elasticity or little elasticity, in tensioning direction, and flat, smooth, and dirt-repellent surface on the side which comes into supporting contact with the circular goods 1. Furthermore, the material of the belt element B is permanently resistant to temperatures of up to about 200° C. and for a short time up to about 350° C., and is furthermore resistant to all chemicals used in the textile industry with which the belt element B could come into contact upon the singeing. Finally, it also has a low coefficient of thermal expansion. A reinforced rubber belt is preferably used as belt element B.

The hollow columns 30 are cylindrical pipe sections of vertical length which brings them up into the drive region located at the bottom in the drawings. The belt element B extends in horizontal direction, on the other hand, in the other, upper end region of the hollow columns 30. Belt element B and the two hollow columns thus impart a gantry-like shape to the flat spreader 4.

The belt element B has a clearly reduced height—a reduced width with respect to a belt—as compared with the U-parts 4', 4" described in connection with the first embodiment. The singeing slot 2 of the singe burner 3, more precisely of the two long-burner elements I, lies spatially within the said width of the belt element B, and in fact closer to the lower narrow side 31 of the belt element B.

The circular-burner elements II are in this case also offset in height with respect to the long-burner elements I. Referred to the direction of travel of the goods designated by the arrow x, the circular-burner elements II are located below the belt element B, approximately at the mid-height between the upper level which is occupied by the belt element B and the lower level of the singeing device V which forms the drive.

The parallelly extending flat sides a of the cloth guide W of the flat spreader 4 are formed by two belt elements B. The means are developed practically identically, both structurally and functionally (see FIG. 8). The fittings, which are accordingly provided twice, are explained below on the basis of one of the identical devices. Thus the winding reserve 32 of a belt element B is held on a winding roller 33 which is seated on a vertically directed support shaft 34 in the inside 35 of the hollow column 30 which at the same time forms a device housing. The delivering and the pulling in again of the winding reserve takes place over the transition sides b of the flat spreader 4, more precisely of the hollow columns 30, which here create semi-spherical outer wall sections of these transition sides b facing way from each other. The one end, remote from the winding, of the belt element B forming the one flat side a is fastened as fixed end 36 to, in each case, the other hollow column 30. As shown in the diagram, this may be effected by a clamp 37 which permits, at any time, the exchange of the tape, or re-equipping of the flat spreader 4.

The winding roller 33 is a spool body consisting of a widening core with end disks which support and guide the belt element B.

As can be noted from FIG. 8, the grasped fixed end 36 is an end section of the belt element F which is bent-off with a sharp edge and directed radially inward.

The access to this point of attachment on the one hand and the place of emergence of the belt element 2 on the other hand consist of a window opening 38 provided there in the circumference of the hollow column 30. The window opening 38 lies in a "shadow zone", i.e. outside of the region of action of the long-burner elements I and, as a result of the aforementioned difference in height, also outside of the region of action of the circular-burner elements II on the transition region b.

On the other side, the window opening 38 can also be closed except for a minimal place of passage so that the sliding of the circular goods 1 over it rear is practically continuous.

In order that the transfer of the winding reserve 32 can be easily brought out and brought in again as portion extending the flat sides without the formation of crease marks, a guide roller 39 is associated with the said window opening 38 close to the edge of the window. This roller is also arranged within the inside 35 of the hollow column 30 which is of circular cross section.

The guide roller 39 is seated on a support shaft 40 which is also directed vertically. On the basis of the said cross-sectional geometry of the hollow columns 30, the two support shafts 34 and 40 are furthermore displaced a reasonable amount peripherally out of the center 41 of the hollow columns 30 so that, on the one hand, no mutual interference is present but, on the other hand, the cylindrical inner space established, and therefore the inside 35, can be utilized as well as possible. The two supporting shafts 40 lie on a diameter.

The introduction of the belt element 2 from the tangential application against the hollow column 30 over the smallest possible arcuate circumferential section into the spreader column 30 approximately a quarter of the belt element wrapping there is sufficient for the entrance and exit. The entrance and/or exit is arranged set back by this angular amount from the hollow column 30.

In the region of the belt guidance, the hollow columns 30 have a guide surface 42 which is set back by the thickness of the belt (see FIG. 9). Such a guidance of the belt can be produced simply by the inward-directed set-off of the wall of the hollow column 30 which is adapted to the width of the wall of the belt element. Such a depression leads to parallel-extending arcuate flanks 43. They lie parallel to the plane E—E and thus extend perpendicular to the vertical direction of the hollow columns 30. Accordingly, the lower narrow side 31 of the belt element B rests on the lower flank 43 and an upper narrow side 31' which extends parallel to the narrow side 31 rests against the corresponding upper flank 43'. The wide-groove guide surface 42 need be provided only in the region of contact of the belt.

In order to hold the belt element B, i.e. the flat sides a which freely bridge over the free space or spacing 44 between the hollow columns 30 on the one hand taut in every pulled-out length and on the other hand to assure an automatic winding up upon the shortening of this distance 44, the winding rolls 43 are under return spring tension. For this, there is provided a pre-stressed torsion spring 45. It is seated below the roller 33. The torsion spring 45 acts in rotating manner on a shaft extension 46 of the support shaft 43 of the winding roller 33. The shaft extension 46 extends accordingly to below a supporting bracket 47 developed as transverse wall in the inside 35 of the hollow column 30. The torsion spring 45 is so pre-stressed that it still exerts the desired return action/tensioning action on the belt element B even when narrower circular goods 1 are used.

Both ends of the hollow columns 30 pass at their free ends into tapered frustoconical sections 30' and 30" respectively. The lower one is designated 30".

With respect to the support rollers 8 and 9 present in the lower region, they, in accordance with the second embodiment, are no longer borne by the spreading horns 6 which extend downward from the flat spreader 4, but are also arranged partially in the inside 35 of the hollow columns 30. Their support-active section pass freely through openings 48 in the hollow columns 30. The transport roller 10 of the drive/displacement device 22 which has been described in detail above lies opposite said support rollers 8, 9. In front of the lower frustoconical section 30" there is furthermore a lower holder 49. It lies just below the spindle 17 which is responsible for the width displacement.

Upper holders 50 extend over the upper end of the two hollow columns 30 which is closed there by the frustoconical section 30'. They are arranged behind the belt element or elements B in the direction of travel x of the cloth. These upper holders 50 are fastened to the sides of the hollow columns 30 which face each other. Accordingly, there are semi-spherical outer wall sections of the hollow columns 30 facing each other. From them, supports 52 secured by clamps 51 extend in displaceable and lockable manner. The clamps 51 lie below the belt element B. The flagpole-like supports extend through the space 44 or also through the transverse spacing 53 of the belt element B which is determined by the diameter of the hollow columns 30.

The function of this singeing device V and its flat spreader 4 is, briefly summarized, the following: In order to change the support surface of the flat spreader 4 so as to adapt it to different size circular goods 1, one of the two hollow columns 30 is, for instance in order to increase the support surface, moved so as to increase the space 44 between them. It is sufficient if, for instance, the right hollow column 30 is displaceable in this sense. In view of the fact that the fixed end 36 remote from the winding is held by, in each case, the other hollow column 30, the winding reserve 32 unwinds continuously against the return force of the torsion spring 45. When the desired spread contour of the circular goods 1 is reached, this is stopped. The operation can proceed. In the event of a desired reduction in the support surface, i.e. in particular a reduction in the length of the flat sides a, the movable hollow column 30 need simply be moved so as to reduce the distance 44. In this case, the winding reserve 32 rests automatically while maintaining tension, again continuously on the belt element or elements B.

From the standpoint of the gassing, there is the advantage that an undisturbed, flat, projection-free abutment is present by the outer side of the belt element B up to the corresponding diameter of the hollow-column cross sections which is parallel to the transverse distance 53 and before same also undisturbed over the transition side b formed by the semi-spherical outer surface of the hollow column 30. A homogeneous, stripe-free condition of the cloth is obtained.

As belt material, rubber belt blocked against stretching is preferably used in a thickness of about 2 mm; plastic-coated fabric belts are also possible, if only because of their good sliding properties. Such materials have the advantage of less thermal expansion over the conventional metal belts, which, of course, can also be used, particularly on basis of the latent tensile stressing on them. Furthermore, as a result of this tensile stress there is less distortion.

We claim:

1. A singeing device for the gassing of circular goods, including circular knitted textile goods, the device having a singe burner and a cloth guide, wherein the cloth guide comprises:

means for producing flat sides of the circular goods, which flat sides extend substantially parallel to each other;

means for producing rounded transition sides of the goods; and wherein the singe burner includes means for gassing the circular goods both on the flat sides and on the transition sides.

2. A singeing device according to claim 1, wherein the singe burner comprises substantially straight long-burner elements for gassing the side surfaces of the goods and, substantially arcuate circular-burner elements for gassing the transition sides of the goods.

3. A singeing device according to claim 2, wherein the long-burner elements and the circular-burner elements overlap in a direction of travel of the goods.

4. A singeing device according to claim 1, wherein the singeing device is displaceable with respect to the width of the flat sides for adaptation to different sizes of circular goods.

5. A singeing device according to claim 4, wherein the singeing device is telescopic for a displacement of the singeing device.

6. A singeing device according to claim 5, wherein the singeing device is spring-urged in the direction of its greatest possible displacement.

7. A singeing device according to claim 6, further comprising transport rollers, wherein an urging of the singeing device is taken up by the transport rollers.

8. A singeing device according to claim 6, further comprising a spindle device, wherein the singeing device is displaceable by a spindle drive.

9. A singeing device according to claim 2, wherein the circular-burner elements can be swung out of their singeing position into a spaced position.

10. A singeing device according to claim 2, further comprising a spindle drive, wherein at least one of the circular-burner elements is displaceable on a spindle of the spindle drive.

11. A singeing device according to claim 10, wherein the circular-burner element is displaceable from the spindle drive.

12. A singeing device according to claim 10, further comprising a carriage supporting one of said circular-burner elements wherein the carriage is movable parallel to the spindle drive.

13. A singeing device according to claim 2, wherein the long-burner elements are adapted in their length to a maximum width of displacement of the singeing device.

14. A singeing device according to claim 2, wherein a widening part of the singeing device controls a burner-slot slide of the long-burner elements.

15. A singeing device according to claim 1, further comprising an extendable belt element disposed within the cloth guide, wherein the flat sides are formed from the extendable belt element.

16. A singeing device according to claim 15, wherein the belt element is unwindable for a lengthening of a goods-supporting region of the belt element.

17. A singeing device according to claim 15, wherein a winding reserve of the belt is arranged in one of the transition sides.

18. A singeing device according to claim 17, further comprising a hollow column at the transition side.

19. A singeing device according to claim 18, wherein the winding reserve is received in the inside of the hollow column.

20. A singeing device according to claim 15, further comprising a hollow column, wherein one end of the belt element is attached to the hollow column.

21. A singeing device according to claim 15, further comprising a first and a second hollow column, and a further extendable belt element, wherein both of said hollow columns receive both a fixed end and a winding reserve of the belt elements.

22. A singeing device according to claim 18, further comprising a winding roller within the hollow column, wherein the winding reserve is taken up on the winding roller and passes through a window opening in the circumference of the hollow column.

23. A singeing device according to claim 22, wherein the winding roller is under return-spring action.

24. A singeing device according to claim 22, wherein a guide roller is arranged in front of the window opening on the inner side of the hollow column.

25. A singeing device according to claim 20, wherein an entrance is arranged, set back by about one quarter of a wrap from an exit of the belt element, in front of the hollow column.

26. A singeing device according to claim 25, wherein the hollow column is provided, in the region of a belt guide of the belt element, with a guide surface, set back by a thickness of the belt, for the belt element.

27. A singeing device according to claim 15, wherein the belt element is a rubber belt.

28. A singeing device according to claim 2, further comprising an extendable belt element disposed within the cloth guide, wherein the long-burner elements are arranged in the region of the belt element.

29. A singeing device according to claim 2, further comprising an extendable belt element disposed within the cloth guide, wherein the circular-burner elements are offset in height from the long-burner elements and are arranged below the belt element, seen in a direction of travel of the goods.

30. A singeing device according to claim 21, further comprising holders for individual ones of the circular goods, which holders are arranged behind the belt elements as seen in a direction of travel of the goods, said holders, extending from the sides of respective ones of the hollow columns.

* * * * *